US009464766B2

(12) United States Patent
Clauss et al.

(10) Patent No.: US 9,464,766 B2
(45) Date of Patent: Oct. 11, 2016

(54) FACADE LIGHT COMPRISING LIGHT-EMITTING DIODES

(75) Inventors: Bernd Clauss, Feldkirch (AT); Daniel Eberle, Dornbirn (AT); Karl-Heinz Rüf, Dornbirn (AT); Peter Roos, Fuchstal Leeder (DE)

(73) Assignee: ZUMTOBEL LIGHTING GMBH, Dornbirn (AT)

( * ) Notice: Subject to any disclaimer, the term of this patent is extended or adjusted under 35 U.S.C. 154(b) by 18 days.

(21) Appl. No.: 13/985,225

(22) PCT Filed: Feb. 17, 2012

(86) PCT No.: PCT/EP2012/052766

§ 371 (c)(1),
(2), (4) Date: Dec. 17, 2013

(87) PCT Pub. No.: WO2012/110633

PCT Pub. Date: Aug. 23, 2012

(65) Prior Publication Data

US 2014/0185289 A1 Jul. 3, 2014

(30) Foreign Application Priority Data

Feb. 18, 2011 (AT) ..... GM101/2011

(51) Int. Cl.
*F21K 99/00* (2016.01)
*F21V 15/01* (2006.01)
(Continued)

(52) U.S. Cl.
CPC ..... *F21K 9/50* (2013.01); *F21V 15/01* (2013.01); *F21V 15/013* (2013.01); *F21V 23/02* (2013.01);
(Continued)

(58) Field of Classification Search
CPC .... F21V 15/001; F21V 29/22; F21V 15/011; F21V 15/013; F21V 29/507; F21V 29/763; F21V 17/164; F21V 29/508; F21V 29/70; F21W 2131/107; F21K 9/50
USPC ..... 362/240, 221, 630, 631, 373, 294, 362/249.02, 218, 235, 244, 225, 158
See application file for complete search history.

(56) References Cited

U.S. PATENT DOCUMENTS 7,434,959 B1 * 10/2008 Wang ..... F21S 2/005 362/218
7,506,995 B2 * 3/2009 Thomas ..... F21V 15/01 362/227
(Continued)

FOREIGN PATENT DOCUMENTS

CN 201074792 6/2008
CN 201133634 10/2008
(Continued)

OTHER PUBLICATIONS

International Search Report for PCT/EP2012/052766, English translation attached to original, Both completed by the European Patent Office on Apr. 20, 2012, All together 10 Pages.
(Continued)

*Primary Examiner* — Anh Mai
*Assistant Examiner* — Arman B Fallahkhair
(74) *Attorney, Agent, or Firm* — Brooks Kushman P.C.

(57) ABSTRACT

A facade light having a housing for accommodating a lighting device, operating devices and terminals, including light-emitting diodes as the lighting device and lenses for distributing the light emitted by the light-emitting diodes, wherein at least two light-emitting diodes are combined to form LED clusters (1) and a lens (2) is assigned to each LED cluster. The light emitted by the light-emitting diodes of the LED cluster passes through the lens, which is configured in such a way that it generates an elliptical distribution of light. The housing is divided into at least two sections, the first section having space for operating devices and a second section, to the side, containing at least one LED cluster and each LED cluster being coupled to a device for dissipating the heat that arises during operation.

17 Claims, 4 Drawing Sheets

(51) Int. Cl.

| | |
|---|---|
| ***F21V 29/00*** | (2015.01) |
| ***F21V 29/70*** | (2015.01) |
| ***F21V 29/508*** | (2015.01) |
| ***F21V 23/02*** | (2006.01) |
| ***F21V 29/507*** | (2015.01) |
| ***F21V 29/76*** | (2015.01) |
| *F21V 17/16* | (2006.01) |
| *F21W 131/107* | (2006.01) |
| *F21Y 101/02* | (2006.01) |

(52) U.S. Cl.

CPC ..... *F21V 29/507* (2015.01); *F21V 29/508* (2015.01); *F21V 29/70* (2015.01); *F21V 29/763* (2015.01); *F21V 17/164* (2013.01); *F21W 2131/107* (2013.01); *F21Y 2101/02* (2013.01)

(56) References Cited

U.S. PATENT DOCUMENTS

| | | | | |
|---|---|---|---|---|
| 7,588,355 | B1 * | 9/2009 | Liu | F21S 2/005 362/240 |
| 7,637,637 | B2 * | 12/2009 | Liu | F21S 8/086 362/218 |
| 7,686,469 | B2 * | 3/2010 | Ruud | F21S 2/005 362/101 |
| 7,744,258 | B2 * | 6/2010 | Liu | F21S 8/086 362/294 |
| 7,771,099 | B2 * | 8/2010 | Massaro | H04M 1/22 362/23.13 |
| 7,810,958 | B2 * | 10/2010 | Liu | F21V 25/04 362/218 |
| 8,529,085 | B2 * | 9/2013 | Josefowicz | F21S 8/086 362/158 |
| 2008/0002399 | A1 | 1/2008 | Villard et al. | |
| 2009/0244927 | A1 * | 10/2009 | Liu et al. | 362/656 |
| 2010/0271822 | A1 * | 10/2010 | Luo et al. | 362/249.02 |
| 2010/0302758 | A1 * | 12/2010 | Wang | 362/20 |
| 2010/0315252 | A1 * | 12/2010 | Desphande et al. | 340/670 |
| 2012/0026737 | A1 | 2/2012 | Dinc et al. | |

FOREIGN PATENT DOCUMENTS

| | | |
|---|---|---|
| CN | 101655204 | 2/2010 |
| CN | 201593732 | 9/2010 |
| CN | 201615376 | 10/2010 |
| CN | 201655204 | 11/2010 |
| DE | 102009016256 | 10/2010 |
| EP | 2280213 | 2/2011 |
| WO | 2005024291 | 3/2005 |
| WO | 2009026736 | 3/2009 |

OTHER PUBLICATIONS

Austrian Search Report for Application No. GM 101/2011, Completed by the Austrian Patent Office on Mar. 30, 2012, 3 Pages.

* cited by examiner

FACADE LIGHT COMPRISING LIGHT-EMITTING DIODES

CROSS-REFERENCE TO RELATED APPLICATION

This application is the U.S. national phase of PCT Application No. PCT/EP2012/052766 filed on Feb. 17, 2012, which claims priority to Austrian Patent Application No. GM 101/2011 filed on Feb. 18, 2011, the disclosures of which are incorporated in their entirety by reference herein.

The invention relates to a facade light comprising a housing for receiving light-emitting diodes and operating devices. In particular whenever facade lights are to be used for presenting color light displays on a facade, nowadays light-emitting diodes (LEDs) are usually used as the lighting means.

WO 2005/024291 A2 discloses a facade light in which light-emitting diodes of different colors are arranged in a series one behind the other. Each individual light-emitting diode is assigned an optical system. The housing is designed such that it is also suitable for cooling the light-emitting diodes.

A disadvantage of the already known facade light is that its overall height is relatively great.

The object of the present invention is to develop a facade light of the type mentioned at the beginning such that it can be made as small as possible. This requires a series of measures, which are listed in the characterizing features of claim 1.

According to the invention, the light-emitting diodes are arranged in LED clusters, each LED cluster being assigned an optical system, through which the light emitted by the light-emitting diodes of the LED cluster passes. The optical system is in this case arranged and formed in such a way that the light emitted by the light-emitting diodes of the LED cluster passes through the optical system, the optical system being designed in such a way that it produces an elliptical light distribution. This achieves the effect that a wide area of a facade can be uniformly illuminated from a central point, to be specific a light source approximately in the form of a point. If a number of facade lights are arranged at a distance from one another and next to one another, a wide strip of a facade can be illuminated, at least approximately, by superposing the individual elliptical light distributions.

It is also essential that the housing is divided into at least two sections, space for operating devices being provided in a first section and at least one LED cluster being arranged in a second section, arranged laterally alongside the first section. Furthermore, each of the LED clusters is cooled and for this purpose is coupled to corresponding means for dissipating the heat produced during the operation of the light-emitting diodes. Altogether, all of these features make it possible that the facade light can be configured with very small dimensions, in particular with a very small overall height. A slender embodiment for the light is preferably achieved in this case by the LED clusters being arranged next to one another, substantially along a straight line.

In the case of facade lights, one of the reasons why the small overall height is of great importance is because facade lights are generally fitted on window parapets or facade elements, but it is endeavored for architectural reasons to place the facade light so as not to be seen, or at least scarcely seen, by an observer of the building. If the facade light has a sufficiently small overall height, as from a certain viewing angle it can no longer be seen because it is covered by window parapets or facade elements.

In a preferred embodiment, the facade light has a housing which is divided into three sections, space for operating devices being provided in the middle section and at least one LED cluster being respectively arranged in the lateral sections. In this arrangement, it is possible in a particularly advantageous way to realize the superposing of the elliptical light distribution, and consequently the strip-form illumination of a facade. This is so all the more in the case of an embodiment of the invention in which two LED clusters are respectively arranged in the lateral sections.

According to a preferred embodiment, the means for dissipating the heat may have air gaps, which are formed in the housing, in particular between a receiving region for the LED clusters and a peripheral housing wall. It has been found that, in spite of a compact construction of the light, a very effective dissipation of the heat can be achieved by this measure, which is indispensable for reliable operation of the light.

As an alternative or in addition to the use of the air gaps, the LED clusters may however also be cooled by means of one or more heat sinks, these likewise being placed or formed in the lateral sections of the housing. An LED cluster consists of at least two light-emitting diodes, with preference three light-emitting diodes, of different colors and/or colour temperatures. The light-emitting diodes are arranged with preference on a first side of printed circuit boards, in particular metal-core printed circuit boards. The printed circuit boards are in this case in heat-conducting connection with the heat sink on the side that is opposite from the first side.

Preferably, the heat sink may be formed in one piece and, with the housing divided into three sections, is accordingly likewise divided into three sections. In the first section, the heat sink is connected in a heat-conducting manner to the printed circuit board arranged in the first lateral section of the housing, in the second or middle section, the heat sink bridges the space for the operating devices and, in the second lateral section, the heat sink is connected in a heat-conducting manner to the printed circuit board arranged in the third section of the housing.

In the case of the housing, if it is formed by a lower housing part and an upper housing part, the lower housing part may be configured as a heat sink. In this case, it is a preferred possibility for the lower housing part to be produced as an aluminum diecasting.

With preference, the heat sink has in the region of the lateral sections cooling ribs which rise up from one side of a base, the height of the cooling ribs corresponding approximately to the depth of the space that is provided for receiving operating devices. This creates a body of which the outer contour approximates a cuboid. Preferably, the side of the base opposite from the aforementioned side may serve as a contact area between the printed circuit board and the heat sink.

The heat sink may form in the middle section a space for receiving operating devices that is closed on all sides with the exception of the upper side.

The upper housing part is preferably produced from plastic, lightproof regions being produced from polycarbonate and light-transmissive regions being produced from polymethyl methacrylate and the upper housing part being produced by means of two-component injection-molding processes. This combination is of advantage in particular in the case of the facade light according to the invention, because clear, light-transmissive polycarbonate yellows under exposure to the sun, while polymethyl methacrylate is scarcely susceptible to this. On the other hand, polymethyl methacrylate is not well suited for realizing the snap closures described below, because polyethylene methacrylate is more brittle and sensitive to stress cracks than polycarbonate.

A facade light must generally be made weatherproof, i.e. the interface between the upper housing part and the lower housing part must be sealed against the ingress of dirt and moisture. For this purpose, the lower housing part may have a peripheral web, on which a peripheral seal is arranged. If the upper housing part is then fastened to the lower housing part by means of a snap connection, the upper housing part can be pressed against the seal, whereby the latter is clamped between the upper housing part and the lower housing part and thus ensures the impermeability.

With preference, the snap connection may be realized by the upper housing part engaging laterally over the lower housing part or—in the case where the air gaps are used—engaging in the air gaps running around the inner periphery of the lower housing part, the lateral regions of the upper housing part, which may for example be configured in the manner of flaps or as side walls, being provided with clearances into which snap lugs engage when the lower housing part is closed by the upper housing part, the snap lugs being integrally formed on the lower housing part.

It should be pointed out that this manner of closing the upper housing part by the lower housing part is not restricted to use in the case of a facade light according to the invention, but instead this closure can be used in the case of any light that has to be protected from the ingress of dust, dirt and moisture. This closure is distinguished in particular by the fact that the light can be closed quickly and without any tools, while the impermeability is ensured. In the case of facades, for example, a very large number of such lights are often used. Consequently, ease of fitting is an important criterion for facade builders or electricians in the selection of such lights. To this extent, the invention also relates to a light of a higher protection class with such a closure.

The invention is to be explained in more detail below on the basis of the accompanying drawing, in which.

Figure 1:
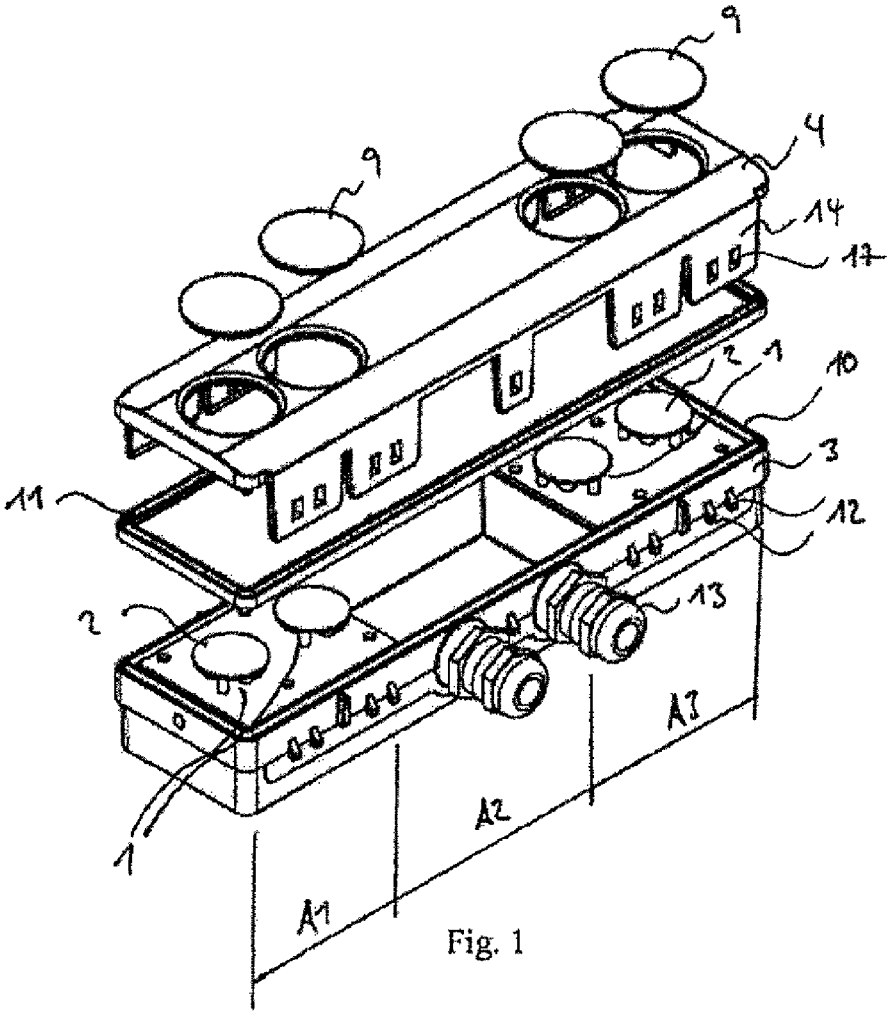
FIG. 1 shows an exploded representation of a first exemplary embodiment of a facade light according to the invention.

In FIG. 1, an exploded representation of a first exemplary embodiment of a facade light according to the invention is shown. The facade light has a housing, which consists of a lower housing part 3 and an upper housing part 4. The lower housing part is divided into three sections A1, A2, A3. Two LED clusters 1 are respectively arranged in the lateral sections A1 and A3. An LED cluster 1 is formed by at least two light-emitting diodes. Preferably, three light-emitting diodes are used per LED cluster, to be precise with the colors red, green and blue; it is similarly possible to use two, preferably three, white light-emitting diodes per LED cluster 1.

Arranged upstream of each LED cluster in the light exiting direction is an optical system 2. This optical system 2 produces an elliptical light distribution on the irradiated surface. By appropriate spatial placement within the facade light, the four LED clusters 1 together with the altogether four optical systems 2 produce a light distribution that lights up a wide strip on the surface to be illuminated, that is to say generally on a facade or wall. A slender construction of the facade light is ensured in this case by the LED clusters being arranged next to one another, in particular substantially along a straight line. The straight line runs parallel to the longitudinal extent of the elliptical light distribution, preferably centrally through the light.

Figure 2:
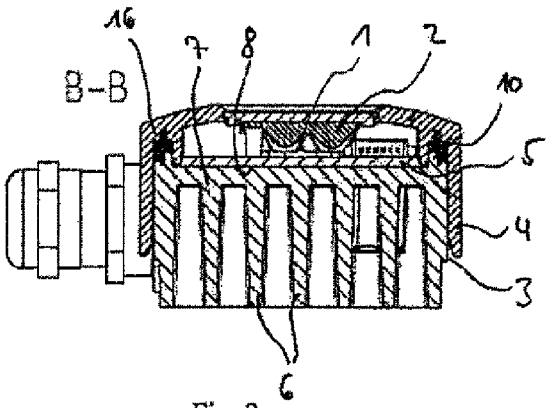
FIG. 2 shows a section B-B corresponding to FIG. 3.
Figure 4:
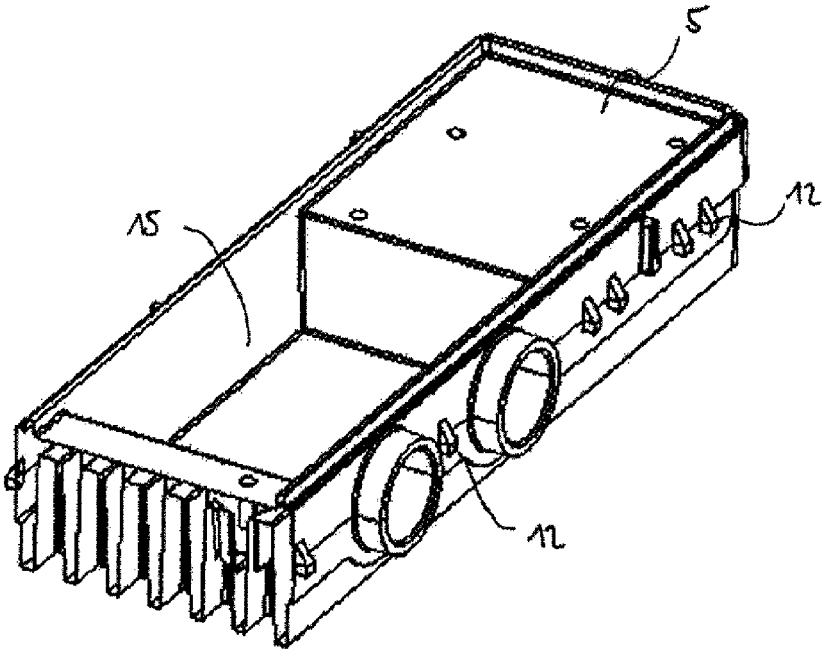
FIG. 4 shows a lower housing part for a facade light according to FIG. 1.
Figure 5:
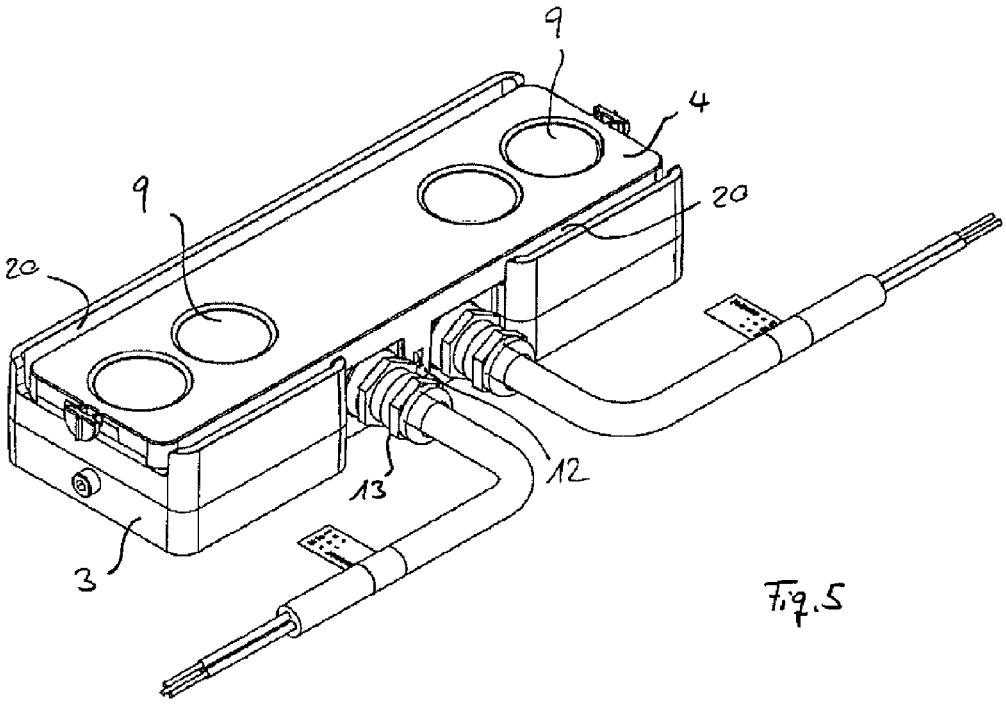
FIG. 5 shows a perspective view of a second exemplary embodiment of a facade light according to the invention.
Figure 6:
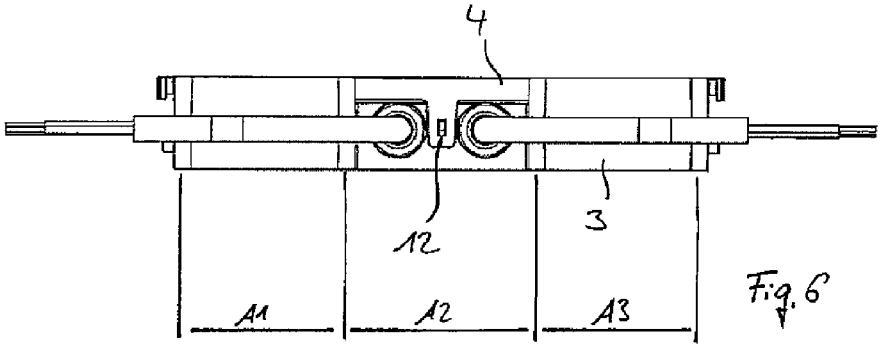
FIG. 6 shows a frontal view of the facade light according to FIG. 5.

The light-emitting diodes of the LED clusters 1 are attached or soldered on printed circuit boards 5. As can be seen in FIG. 2, the printed circuit boards 5 lie with their rear sides on a contact area 8 of the base 7 of the heat sink. In the exemplary embodiment according to FIG. 1, the lower housing part 3 is at the same time configured as a heat sink. Configured in this way as a heat sink, the lower housing part 3 has in the region of the lateral sections A1 and A3 cooling ribs 6, which are integrally formed on the base 7. The cooling ribs 6 run in the longitudinal direction of the lower housing part 3. For esthetic reasons, the lower housing part is enclosed by substantially straight and smooth outer walls. This design is possible because the lower housing part 3 is made as an aluminum diecasting. However, in particular when a greater cooling performance is required with the same surface area, the outer walls at the ends may be omitted, in order to make improved air circulation possible. According to FIG. 4, the overall height of the cooling ribs 6 with the base 7 corresponds approximately to the depth of the receiving space 15. This creates a body of which the outer contours approximate a cuboid, in which the internal space is optimally divided for the different uses, to be specific as a space for receiving printed circuit boards 5, LED clusters 1 and optical systems 2, which all have a relatively small installation depth requirement—compare in this respect FIG. 2—and operating devices and connection terminals, which have a relatively large spatial requirement.

Accordingly, operating devices, such as for example LED drivers or control units, such as for example DMX controllers and electrical terminals (not represented), can be accommodated in the middle section. The electrical supply takes place by way of commercially available screwed cable glands, through which a cable (not represented) can be led and which seal the housing and the cable with respect to one another. Preferably, the facade light according to the invention is supplied with 24 V or 48 V by way of a low-voltage power supply, the supply unit, i.e. the LED driver, usually being placed outside the light and usually only the control unit together with the terminals (not represented) being arranged in the space that is provided for the supply unit.

The receiving space 15 and the two lateral sections A1 and A3 are closed off toward the upper side by a peripheral web 10. This web 10 receives a peripheral seal 11, the profile of the seal being adapted to the contour of the web 11—as can be seen in FIG. 2. It can likewise be seen in FIG. 2 that the seal 11 engages in a peripheral groove 16 of the upper housing part 4.

In the assembled state of the upper housing part 4 and the lower housing part 3, these two housing parts press the seal together, in order in this way to ensure secure sealing against dust, dirt and moisture.

The upper housing part 4 is formed by a light-impermeable part, which is produced with preference from polycarbonate and in the present exemplary embodiment is produced from four circular light-transmissive, fully transparent covering elements 9, which are produced with preference from polymethyl methacrylate. The production of the upper housing part 4 may take place by means of two-component injection molding.

Figure 3:
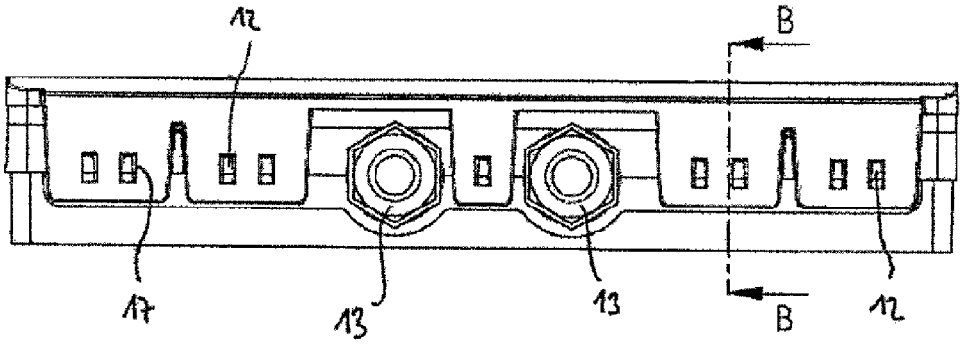
FIG. 3 shows a frontal view of the facade light according to FIG. 1.

In FIG. 3, a frontal view of the exemplary embodiment according to FIG. 1 is shown. The upper housing part 4 engages over the lower housing part 3 with side walls 14 formed in the manner of flaps, the side walls being provided with clearances 17, which interact with snap lugs 12 and form the snap closure between the upper housing part 4 and the lower housing part 3. In fact, altogether nine snap lugs 12 are arranged on one side of the lower housing part 3, distributed over the flap-like side wall.

A second exemplary embodiment of a facade light according to the invention is represented in FIGS. 5 to 8, the same elements being provided with the same designations. With regard to the division of the housing into lateral sections A1 and A3 for the arrangement of the LED clusters 1 and a section A2 for receiving the operating devices and further components, this second exemplary embodiment is the same as the example of FIGS. 1 to 4. The means for influencing the light emission are also identical here, for which reason primarily the differences are to be explained below.

A major difference in the case of this second exemplary embodiment is that the dissipation of the heat occurring during the operation of the LEDs takes place primarily with the aid of air slits 20, which are formed in the housing in the vicinity of the LED clusters 1. In particular, these air slits 20 are formed at the inner periphery of the wall of the lower housing part 3, which is achieved by a corresponding—at least partial—double-walled configuration of the housing wall. In this case, the upper housing part 4 then no longer engages completely over the lower housing part 3 but is instead designed in such a way that the side wall 14 engages with the flaps in the air slit or air slits 20 and interacts with snap lugs located there. Only in the middle region A2 in the area of the screwed cable glands 13 is the lower housing part 3 not of a double-walled form, so that there a flap engages over the lower housing part 3. The width of the air slits 20 is in this case dimensioned in such a way that, in spite of the engagement of the side wall 14, sufficient free space remains, making it possible for air to flow through and accordingly for the heat to be dissipated effectively. The web 10 located on the lower housing part 3 for receiving the seal 11 is in this case formed offset slightly inwardly on the inner side of the air slits 20, so that as before the required reliable sealing of the light is achieved.

Figure 7:
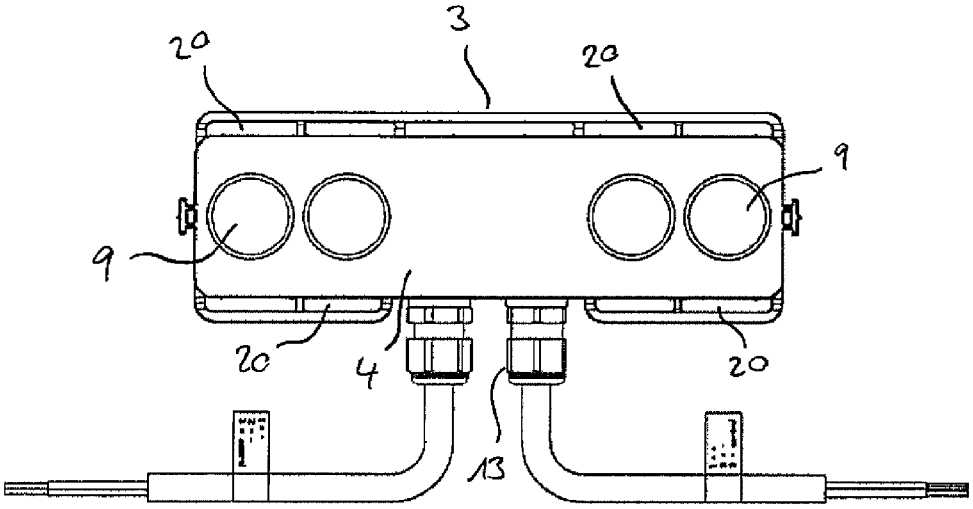
FIG. 7 shows a plan view of the facade light according to FIG. 5.
Figure 8:
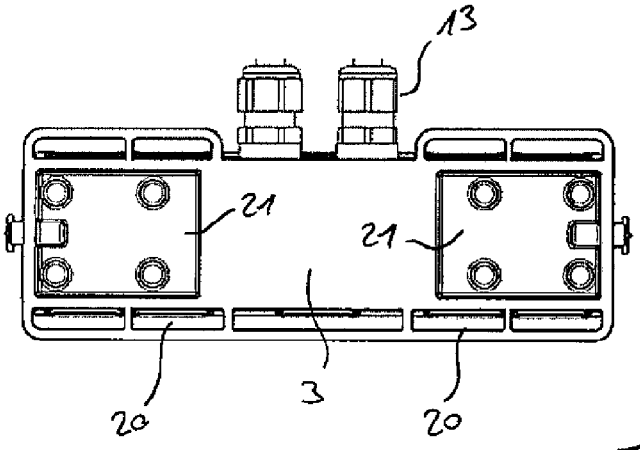
FIG. 8 shows the underside of the facade light according to FIG. 5.

As can be seen accordingly from the plan view of FIG. 7 in particular, respectively formed on the two longitudinal sides of the housing, in the region of the lateral sections A1 and A3 for receiving the LED clusters, are air gaps formed by air slits 20, by which very effective heat dissipation is achieved. It has been found that the action of these air slits 20 is even so effective that no further measures for cooling would be necessary. Accordingly, in the case of this exemplary 25 embodiment it is also possible to dispense with the cooling ribs 6 arranged under the LED clusters 1, such as those provided in the case of the example of FIGS. 1 to 4. Instead, in the case of this variant it is merely provided that substantially square depressions 21 are formed in these regions on the underside of the lower housing part 3. The production of the lower housing part 3, in turn preferably formed as an aluminum diecasting, is simplified as a result. 30 It goes without saying that it would however be conceivable also in the case of the second exemplary embodiment to form additional cooling ribs to increase the cooling performance, if this appeared to be advisable on account of the ambient influences.

LIST OF DESIGNATIONS

1, 1' LED cluster
2 Optical system
3 Lower housing part
4 Upper housing part
5 Printed circuit board
6 Cooling ribs
7 Base
8 Contact area
9 Covering element
10 Web
11 Seal
12 Snap lugs
13 Screwed cable gland
14 Flap-like side wall
15 Receiving space
16 Groove
17 Clearances
20 Air slits
21 Housing depressions

The invention claimed is:

1. A facade light comprising;

a longitudinally elongated housing for receiving lighting operating devices and terminals, light-emitting diodes and optical systems for distributing the light emitted by the light-emitting diodes, wherein at least two light-emitting diodes are combined to form each of a plurality of LED clusters, each of the LED clusters is assigned to one of the optical systems, the light emitted by the light-emitting diodes of the LED clusters passing through the optical systems which are designed in such a way that it produces a longitudinally extending elliptical light distribution pattern on a facade to be illuminated, wherein the plurality of LED clusters are longitudinally arranged next to one another, substantially along a straight line which runs parallel to the longitudinal direction of the housing and a longitudinal axis of the elliptical light distribution pattern, wherein the housing is in its longitudinal direction divided into at least two sections, space for the lighting operating devices being provided in a first lateral section and space for the plurality of LED clusters being arranged in a second lateral section, and in that each LED cluster is coupled to means for dissipating heat produced during the operation of the LED clusters, and wherein air gaps for further dissipating the heat produced during the operation of the LED clusters are formed in the housing, said air gaps being formed by longitudinally elongated air slits located adjacent to each other on opposed longitudinal sides of the housing between a receiving region for the plurality of LED clusters and a peripheral housing wall.

2. The facade light as claimed in claim 1, wherein the housing consists of a lower housing part and an upper housing part and in that the lower housing part is preferably configured as a heat sink.

3. The facade light as claimed in claim 2, wherein the upper housing part is plastic, having polycarbonate light-proof regions and polymethyl methacrylate light-transmissive regions forming covering elements.

4. The facade light as claimed in claim 3, wherein the upper housing part is a unitary part produced by a two-component injection-molding process.

5. The facade light as claimed in claim 2, wherein the lower housing part is an aluminum diecasting.

6. The facade light as claimed in claim 2, wherein the lower housing part has a peripheral web and in that a peripheral seal is arranged on the peripheral web.

7. The facade light as claimed in claim 2, wherein the upper housing part is fastened to the lower housing part by a snap connection in such a way that the upper housing part is pressed against a seal.

8. The facade light as claimed in claim 1, wherein the housing is divided into three sections, a first lateral section a middle section and a third lateral section, the first lateral section and the third lateral section being respectively arranged at longitudinally opposed sides of the middle section.

9. The facade light as claimed in claim 8, wherein two LED clusters are respectively arranged in the first and third lateral sections.

10. The facade light as claimed in claim 8, wherein the means for dissipating the heat comprises a heat sink formed in one piece, and having three sections, a first heat sink section connected in a heat-conducting manner to a printed circuit board arranged in the first lateral section of the housing and in a second heat sink section bridges the space for the lighting operating devices and, in the second lateral section of the housing, is connected in a heat-conducting manner to a printed circuit board arranged in a third lateral section of the housing.

11. The facade light as claimed in claim 1, wherein the means for dissipating the heat comprises a heat sink, and in the lateral section or sections the LED clusters are assigned a heat sink.

12. The facade light as claimed in claim 11, wherein the light-emitting diodes are arranged on a first side of a metal-core printed circuit board having a heat-conducting connection with the heat sink on the side that is opposite from the first side.

13. The facade light as claimed in claim 11, wherein the heat sink has in the region of the lateral sections cooling ribs which rise up from one side of a base, in that a height of the cooling ribs corresponds approximately to a depth of the space that is provided for receiving operating devices and in that a side of the base opposite from the side which serves as a contact area between the printed circuit board and the heat sink.

14. The facade light as claimed in claim 11, wherein the heat sink forms in the first lateral section a space for receiving operating devices or terminals that is closed on all sides with the exception of the upper side.

15. The facade light, as claimed in claim 1, wherein the housing consists of an upper housing part and a lower housing part, wherein the lower housing part has a peripheral web and in that a peripheral seal is arranged on the peripheral web, wherein the upper housing part is fastened to the lower housing part by means of a snap connection in such a way that the upper housing part is pressed against the seal.

16. The light as claimed in claim 15, wherein the snap connection is realized by the upper housing part engaging laterally over the lower housing part or engaging in air slits formed on the lower housing part and in that the lateral regions of the upper housing part are provided with clearances into which snap lugs engage when the lower housing part is closed by the upper housing part, the snap lugs being integrally formed on the lower housing part.

17. The facade light as claimed in claim 1, wherein the light-emitting diodes and the associated control unit operate at a low-voltage.

* * * * *